US005586372A

United States Patent [19]

Eguchi et al.

[11] Patent Number: 5,586,372

[45] Date of Patent: Dec. 24, 1996

[54] FASTENING DEVICE

[75] Inventors: Tomoo Eguchi, Utsunomiya; Goro Asami, Machida, both of Japan

[73] Assignee: Nifco Inc., Yokohama, Japan

[21] Appl. No.: 610,337

[22] Filed: Mar. 4, 1996

[30] Foreign Application Priority Data

Apr. 5, 1995 [JP] Japan ..... 7-103190

[51] Int. Cl.[6] ..... A44B 18/00

[52] U.S. Cl. ..... 24/452; 24/306; 24/442; 24/447

[58] Field of Search ..... 24/452, 451, 450, 24/449, 448, 447, 446, 445, 444, 443, 442, 306

[56] References Cited

U.S. PATENT DOCUMENTS

| | | | |
|---|---|---|---|
| 3,266,113 | 8/1966 | Flanagan, Jr. | 24/452 |
| 4,322,875 | 4/1982 | Brown et al. | 24/447 |
| 5,040,275 | 8/1991 | Eckhardt et al. | 24/447 |
| 5,212,853 | 5/1993 | Kaneko | 24/452 |

*Primary Examiner*—Victor N. Sakran
*Attorney, Agent, or Firm*—Kanesaka & Takeuchi

[57] ABSTRACT

A fastening device of the invention is formed of two fastening members. Each fastening member has a flat base portion, and a plurality of engaging projections fixed on the base portion laterally and vertically. Each engaging projection has at least one leg fixed to the base portion at one side and an engaging head portion fixed to the other side of the leg. The engaging head portion has a lateral size greater than that of the leg. Non-engaging projections are integrally formed on at least one of the fastening members. Each non-engaging projection has a height less than the engaging projection. In case the two fastening members are engaged, when one engaging projection projecting toward one non-engaging projection is pushed laterally by another engaging projection situated adjacent to the one non-engaging projection, an engaging head portion of the one engaging projection is pushed toward the one non-engaging projection and then is returned to an original portion by the one non-engaging projection to thereby engage the engaging head portions of the one and another engaging projections. Thus, the fastening members can be easily fastened and separated repeatedly.

8 Claims, 9 Drawing Sheets

FASTENING DEVICE

BACKGROUND OF THE INVENTION AND RELATED ART STATEMENT

The present invention relates to a press fastening and removable type fastening device, wherein fastening members are made of plastics, and engaging head portions of engaging projections provided on fastening members are engaged with each other.

Recently, a fastening device made of plastics and capable of press fastening and removing fastening members has been used in various portions.

FIGS. 6(*a*) and 6(*b*) are explanatory views for showing an example of use of the above described fastening device.

In FIGS. 6(*a*) and 6(*b*), P represents an instrument panel of an automobile; R represents a remote control device for an instrument built in the automobile; and F represents a fastening device. The fastening device F makes it possible to detachably attach the remote control device R to the instrument panel P.

Incidentally, the fastening device F is formed of two fastening members 1, and one of the fastening members 1 is fixed to the instrument panel P by, for example, a two-face adhesive tape, and the other of the fastening members 1 is fixed to the remote control device R by the two-face adhesive tape.

Therefore., for example, when a CD player is operated to listen to music, the remote control device R is held by hand to separate the fastening member 1 attached to the control device R from the fastening member 1 attached to the instrument panel, so that the remote control device R can be removed from the instrument panel P. Therefore, the CD player can be operated by using the remote control device R to listen to music.

When the remote control device R is not used, the fastening member 1 of the remote control device R is pressed against the fastening member 1 of the instrument panel P, so that the remote control device R is fixed to the instrument panel P, as shown in FIGS. 6(*a*) and 6(*b*).

In addition to this example, for example, in an automobile manufacturing department, the fastening device has been used as a member for joining interior parts, a joining member for preventing a head lining from hanging down, or a joining member for preventing a glass sheet from lifting.

FIG. 7 is a perspective view for showing an example of a fastening member for constituting a conventional fastening device as described above; FIGS. 8(*a*), 8(*b*) and 8(*c*) are an enlarged perspective view, an enlarged front view and an enlarged side view, of the engaging projection, respectively; FIG. 9 is a bottom view of a base for showing a positional relationship of legs; FIG. 10 is an explanatory view for showing spaces formed by the engaging projections; FIG. 11 is an explanatory view for showing a state of the respective engaging projections at the time of compression; and FIG. 12 is an explanatory view for showing a compression engagement condition of the fastening device.

In the drawings, reference numeral 1 denotes a fastening member integrally formed by injection molding of plastics by using a mold (two face dividing mold). The fastening member includes a flat base 2, and a plurality of engaging projections 4 provided on a main surface of the base 2 arranged in vertical and lateral rows.

Reference numeral 3 represents holes formed on the base 2, and the holes 3 are inevitably formed by the mold when the base 2 and the engaging projections 4 are integrally formed. The holes nave approximately the same shape and the size as those of engaging head portions 6 described later.

Each engaging projection 4 is formed of two legs 5A, 5B extending upwardly from the base 2, and the engaging head portion 6 situated on upper edges of the two legs 5A, 5B.

Incidentally, the engaging head portion 6 may have any desired shape, such as a circle or a polygon in its plane shape, and a dome or flat hemisphere shape in its side shape.

Spaces relative to the adjacent engaging projections 4 are explained. As shown in FIG. 10, when one engaging head portion 6 of the downwardly directed engaging projection 4 of one fastening member 1 is inserted into a cross shape space formed by four engaging head portions 6 of the engaging projections 4 arranged in two vertical rows and two lateral rows in the other fastening member, the engaging head portions 6 are arranged such that the downwardly directed engaging head portion 6 is engaged with the upwardly directed four engaging head portions 6. For example, assuming that a diameter of the engaging head portion 6 is D; a length between two centers of the adjacent engaging head portions 6 in lateral rows and vertical rows is S; and a length of a diagonal line between two centers of the engaging head portions 6 is T, the engaging head portions 6 are arranged to be $D<S<2D$, and $D<T<2D$.

Next, an explanation is made on the two fastening members engaging with and disengaging from each other.

To start with, the two fastening members 1, 1', which are exactly the same, are arranged such that the surfaces provided with the engaging projections 4, 4' face with each other. When one fastening member 1' is pressed against the other fastening member 1 so that the engaging head portions 6' of the fastening member 1' are inserted into the cross shape spaces formed by the engaging head portions 6 of the fastening member 1, since the engaging head portions 6' of the fastening member 1' are disposed to engage or interfere the engaging head portions 6 of the fastening member 1, the downwardly and upwardly directed engaging head portions 6, 6' are collided with each another, as shown in FIG. 11.

Under the condition, when the fastening member 1' is further pressed against the fastening member 1, the upper and lower engaging projections 4, 4' deform, and the engaging head portions 6' of the fastening member 1' pass through the spaces among the engaging head portions 6 of the fastening member 1, so that, as shown in FIG. 12, lower surfaces of the engaging head portions 6, 6' engage with each another to thereby form a compression fastening state.

When a force for releasing the engagement of the lower surfaces as described above is applied to the fastening member 1', the fastening member 1' is removed from the fastening member 1.

Incidentally, although the engaging head portion 6 is supported by two legs 5A, 5B as shown in FIG. 9, the legs 5, 5A and 5B may be arranged as in bottom views of the bases shown in FIGS. 13(*a*), 13(*b*) and 13(*c*).

In this case, when the engaging head portion 6 is supported by one leg 5 as shown in FIGS. 13(*b*) and 13(*c*), the thickness of the leg 5 may be made thicker than that of the legs 5A, 5B in view of strength.

In the fastening members 1, 1' for constituting the conventional fastening device F, the engaging head portions 6 of one fastening member 1 and the engaging head portions 6' of the other fastening member 1' are arranged to engage with each another. Therefore, when the fastening members 1, 1' are arranged to face with each other and are pushed with pressure in order to engage the engaging head portions 6, 6' as shown in FIGS. 10 and 11, since the engaging head portions 6, 6' do not have escaping spaces, they are forcibly pushed to each other.

Therefore, a large insertion force for engaging the engaging head portions 6, 6' together is required. As a result, there has been a disadvantage that the conventional fastening device F is not suitable for repeating use.

Accordingly, one object of the invention is to obviate the above disadvantage and to provide a fastening device, which is suitable for repeating use.

Another object of the invention is to provide a fastening device as stated above, wherein an insertion force for the engaging head portions can be greatly decreased without reducing a force for releasing the engagement of the engaging head portions.

A further object of the invention is to provide a fastening device as stated above, which can be easily and economically manufactured.

Further objects and advantages of the invention will be apparent from the following description of the invention.

SUMMARY OF THE INVENTION

A fastening device of the present invention is formed of two plastic fastening members, wherein each fastening member includes a plurality of engaging projections with elasticity on a flat base in rows in vertical and lateral directions. Each engaging projection has at least one leg and an engaging head portion situated on an upper edge thereof. The respective fastening members are arranged such that the base having the engaging projections face with each other, and the engaging head portions of one fastening member are inserted into spaces among the engaging projections of the other fastening member to thereby engage lower faces of the engaging head portions with each another.

In this fastening device, in the present invention, the engaging projections in at least one of the fastening members are replaced, at a predetermined rate, by non-engaging projections or projections for urging the engaging head portions of the other fastening member to engage the engaging head portions of the one fastening member. The engaging projections and the projections may be alternately disposed in one vertical or lateral row, or may be arranged vertically or laterally in one kind and disposed alternately to each other.

In the fastening device according to the present invention, since the engaging projections in at least one of the fastening members are replaced, at a predetermined rate, by the projections, in case the two fastening members are pressed together to engage the engaging projections one another, intervention among the engaging projections are reduced.

BRIEF DESCRIPTION OF THE DRAWINGS

FIG. 2(*b*) is a partially enlarged sectional view taken along line 2(*b*)—2(*b*) in FIG. 1(*b*);

FIG. 2(*c*) is a partially enlarged sectional view taken along line 2(*c*)—2(*c*) in FIG. 1(*c*);

FIG. 2(*d*) is a partially enlarged sectional view taken along line 2(*d*)—2(*d*) in FIG. 1(*d*);

FIG. 5(*b*) is a partially enlarged sectional view taken along line 5(*b*)—5(*b*) in FIG. 5(*a*);

FIG. 8(*b*) is an enlarged front view of the engaging projection of FIG. 8 (*a*);

FIG. 8(*c*) is an enlarged side view of the engaging projection of FIG. 8(*a*);

DETAILED DESCRIPTION OF PREFERRED EMBODIMENTS

Hereinunder, embodiments according to the present invention are described with reference to the drawings.

Figure 1A:
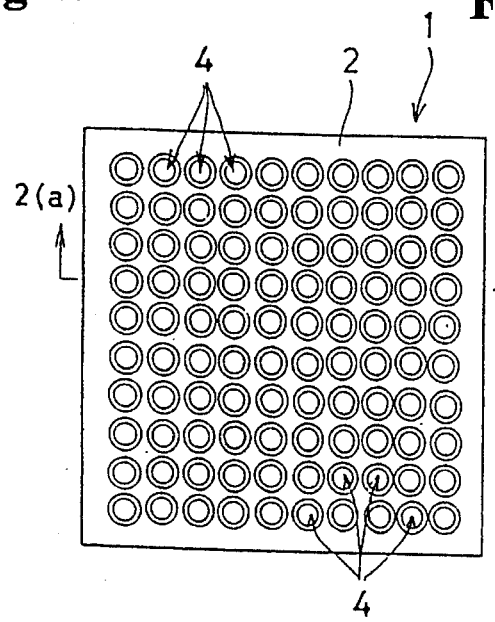
FIGS. 1(*a*), 1(*b*), 1(*c*) and 1(*d*) are explanatory plan views of fastening members to be used in fastening devices according to the present invention.
Figure 1B:
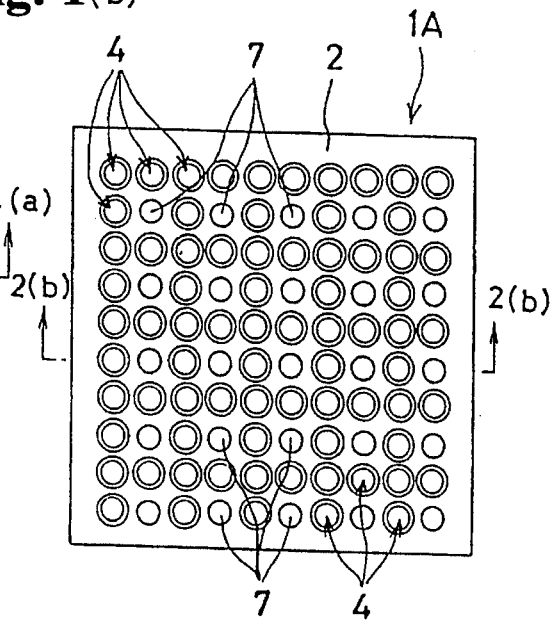
Figure 1C:
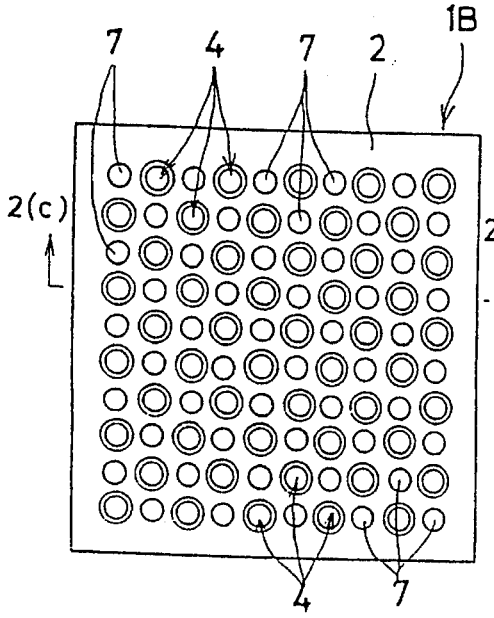
Figure 1D:
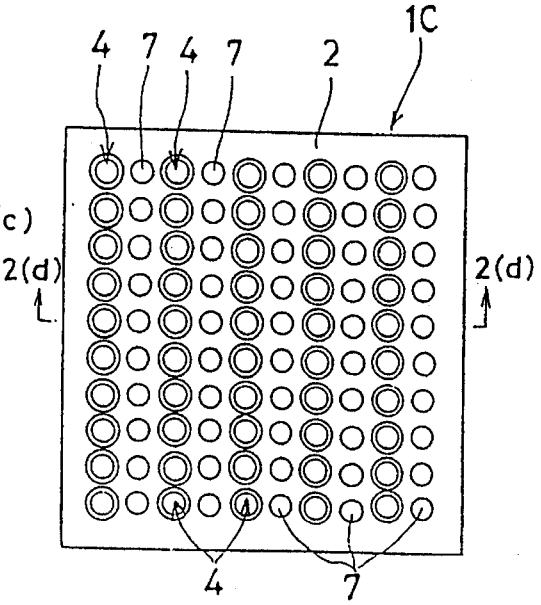
Figure 2A:
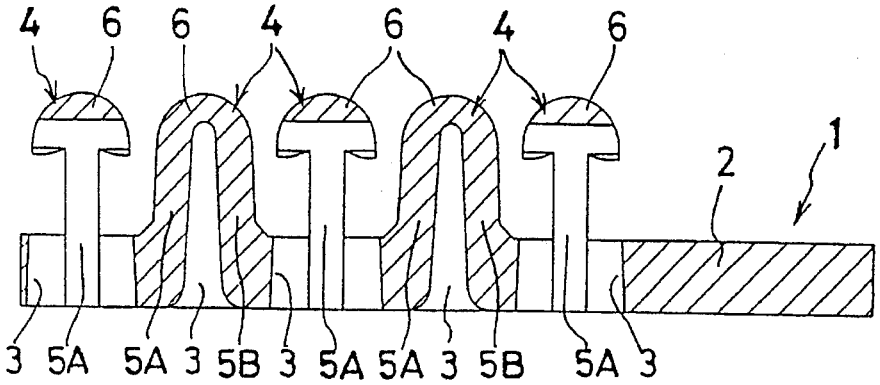
FIG. 2(*a*) is a partially enlarged sectional view taken along line 2(*a*)—2(*a*) in FIG. 1(*a*)
Figure 2B:
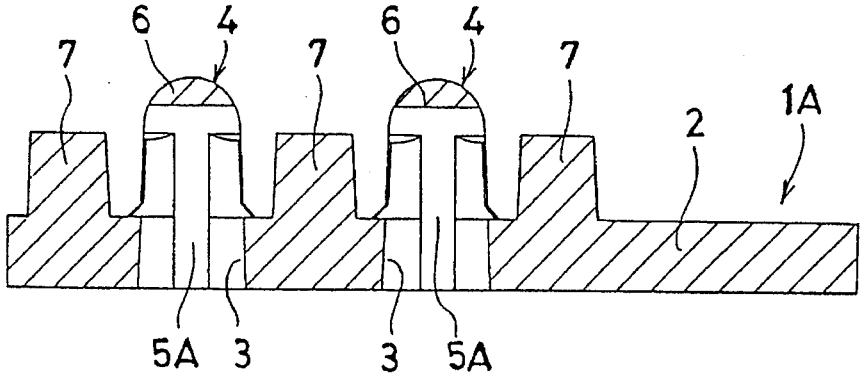
Figure 2C:
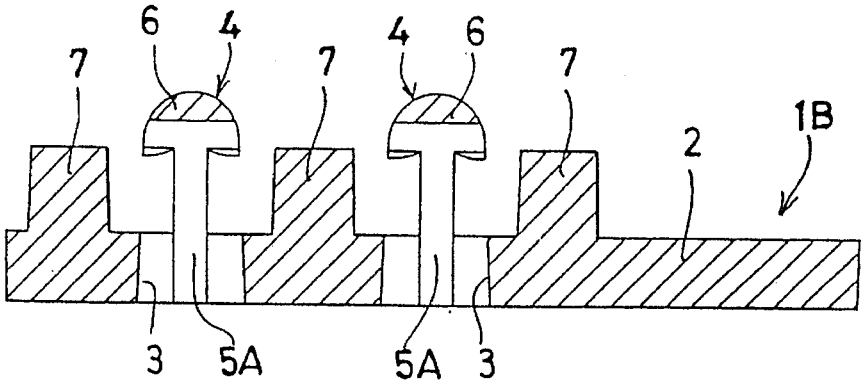
Figure 2D:
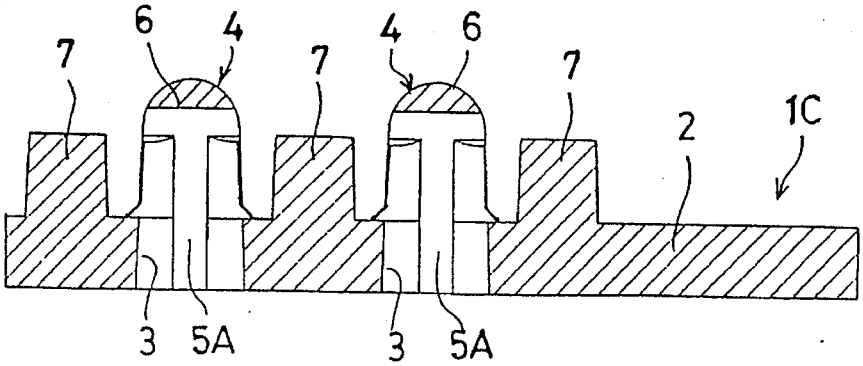
Figure 3:
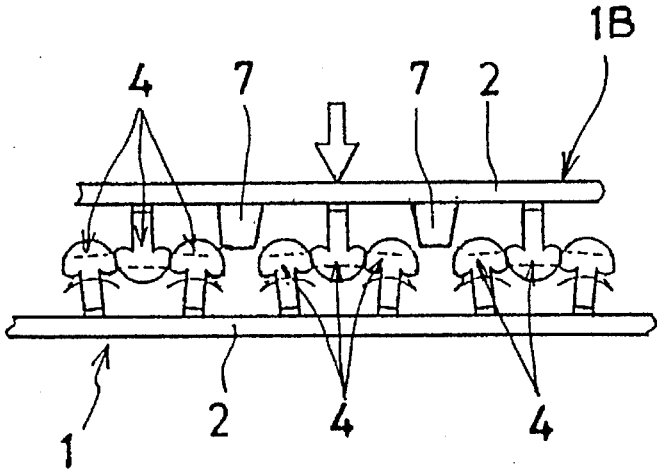
FIG. 3 is an explanatory view for showing an initial state where a pressure is applied between the respective engaging projections.
Figure 4:
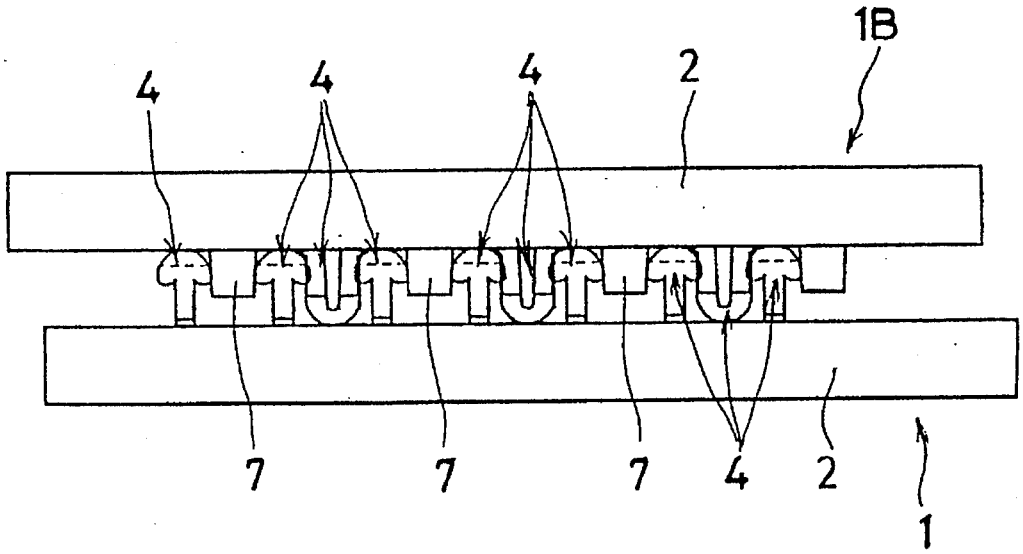
FIG. 4 is an explanatory view for showing a press fastened state of the fastening device.

FIGS. 1(*a*), 1(*b*), 1(*c*) and 1(*d*) are explanatory plan views of fastening members to be used in fastening devices according to the present invention; FIGS. 2(*a*), 2(*b*), 2(*c*) and 2(*d*) are partially enlarged sectional views of FIGS. 1(*a*), 1(*b*), 1(*c*) and 1(*d*), respectively; FIG. 3 is an explanatory view for showing a state of the respective engaging projections at the time of applying pressure; and FIG. 4 is an explanatory view for showing a fastened state of the fastening device. In FIGS. 1–4, the same portions as in FIGS. 6–13 are denoted by the same symbols, and explanations thereof are omitted.

Incidentally, FIG. 2(*a*) is a partially enlarged sectional view taken along line 2(*a*)—2(*a*) in FIG. 1(*a*); FIG. 2(*b*) is a partially enlarged sectional view taken along line 2(*b*)—2(*b*) in FIG. 1(*b*); FIG. 2(*c*) is a partially enlarged sectional view taken along line 2(*c*)—2(*c*) in FIG. 1(*c*); and FIG. 2(*d*) is a partially enlarged sectional view taken along line 2(*d*)—2(*d*) in FIG. 1(*d*). And, double circles in the drawings show engaging projections 4.

In FIGS. 1(*b*), 1(*c*) and 1(*d*), 1A, 1B and 1C represent fastening members, which are integrally formed by injection molding of plastics by using a mold (two face dividing mold). Each fastening member is formed of a flat base 2 and the engaging projections 4 provided on one main surface of the base 2 as in the fastening member 1.

Each engaging projection 4 includes two legs 5A, 5B and an engaging head portion 6, and these engaging projections 4 are disposed with the same spaces and arrangements as those shown in FIGS. 7–12.

Reference numeral 7 represents frustum projections or non-engaging projections. The frustum projections 7 are provided in place of the engaging projections 4 at a predetermined rate. Each projection 7 urges the engaging head portions 6 formed on the other fastening member to engage the engaging head portions 6 of the own fastening member, and has the same height as that of the legs 5A, 5B extending from the base 2.

Incidentally, the fastening member 1 is provided with the engaging projections 4 at a rate of 100% and does not have any projections 7.

The fastening member 1A is provided with the projections 7 at crossing portions of even-numbered lateral rows from the top and even-numbered vertical rows from the left. Thus, the fastening member 1A includes 75% of the engaging projections 4, and 25% of the projections 7.

Further, the fastening member 1B is provided with the engaging projections 4 and the projections 7 alternately in the vertical and lateral rows, so that the rates of the engaging projections 4 and the projections 7 become 50%.

Furthermore, the fastening member 1C is provided with the engaging projections 4 at portions of odd-numbered vertical rows from the left and the projections 7 at portions of even-numbered vertical rows from the left, so that the rates of the engaging projections 4 and the projections 7 become 50%.

Next, press fastening and separating of the two fastening members are explained.

Incidentally, it is assumed that one fastening member is the fastening member 1B shown in FIG. 1(*c*), and the other fastening member is the fastening member 1 shown in FIG. 1(*a*).

Figure 10:
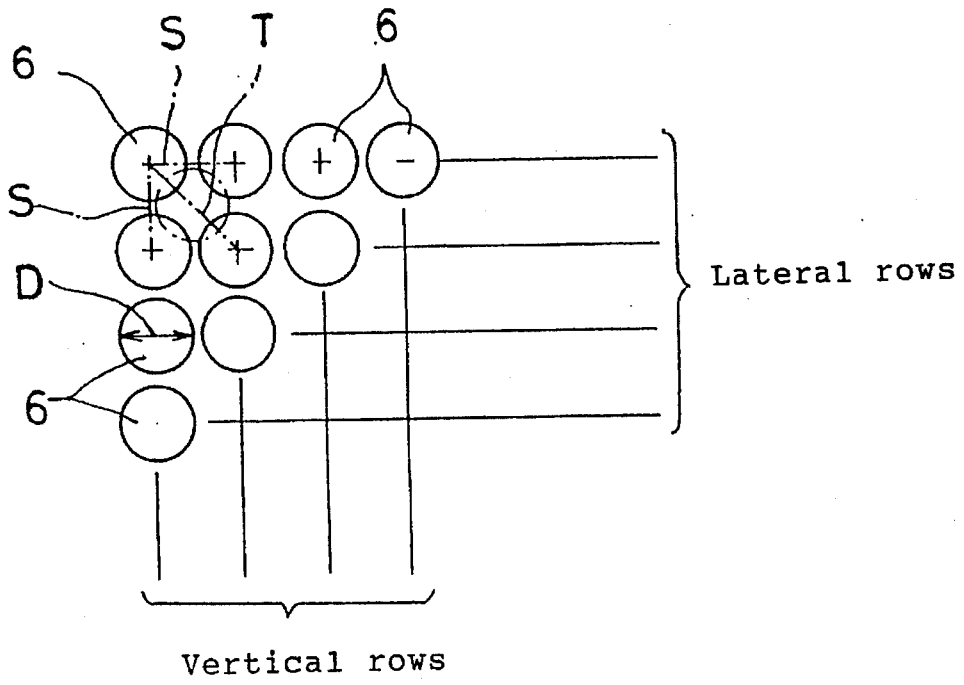
FIG. 10 is an explanatory view for showing a space formed by the engaging projections of the conventional fastening device.
Figure 11:
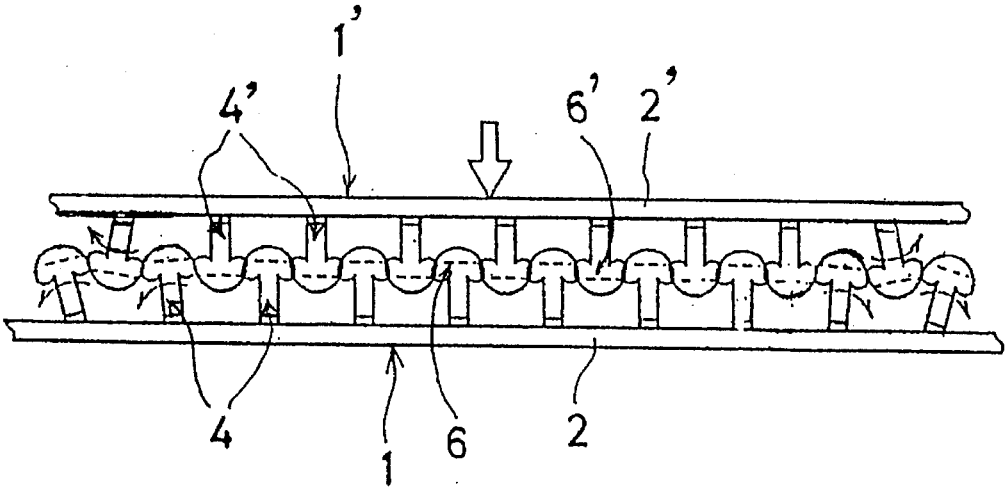
FIG. 11 is an explanatory view for showing the engaging projections at the time of applying pressure in the conventional fastening device.
Figure 12:
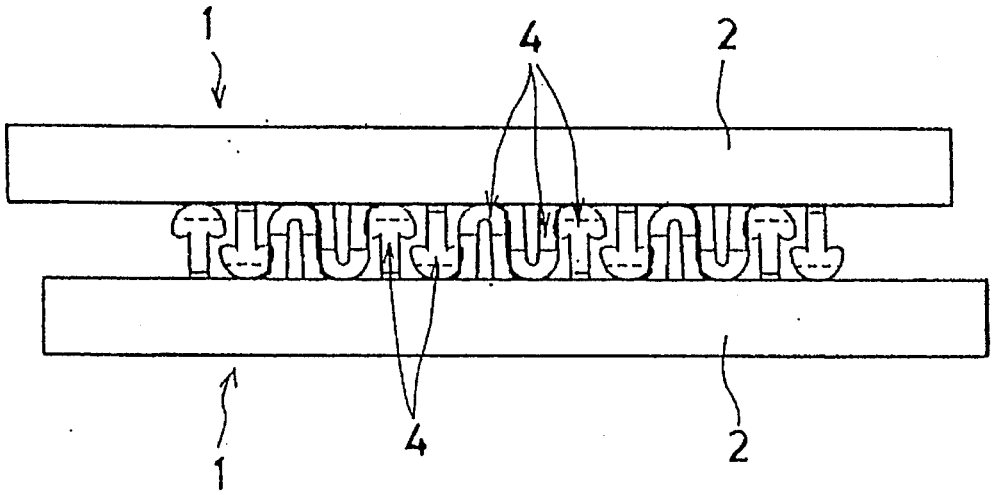
FIG. 12 is an explanatory view for showing a press fastened state of the conventional fastening device.

To start with, the two fastening members 1 and 1B are arranged such that a face with the engaging projections 4 and a face with the engaging projections 4 and the projections 7 face with each other, and the fastening member 1B is pushed against the fastening member 1. As shown in FIG. 10, the engaging head portions 6 of the fastening member 1B are inserted into intersecting spaces formed by the engaging head portions 6 of the fastening member 1 of the vertical and lateral rows, and the engaging head portions of the fastening members 1 and 1B interfere with each another.

However, since the fastening member 1B is provided with the engaging projections 4 and the projections 7 at a rate of 50%, respectively, as shown in FIG. 3, the engaging head portions 6 of the fastening member 1B pass through the spaces among the engaging head portions 6 of the fastening member 1 by widely opening the head portions 6. Then, the engaging head portions 6 of the fastening member 1 abut against the projections 7, respectively and are pushed toward the engaging head portions 6 of the fastening member 1B, so that lower surfaces of the engaging head portions 6 are engaged with each other to thereby form a press contact state, as shown in FIG. 4.

When a force for releasing or separating the engagement of the lower surfaces of the engaging head portions 6 in the press contact state is applied to the fastening member 1B, the fastening member 1B can be separated from the fastening member 1.

Two fastening members were selected from the fastening members 1 and 1A to 1C except for a case where the two fastening members are the fastening members 1 since the case becomes a conventional fastening device, and an insertion force for engaging the engaging head portions 6 and a releasing force for releasing the engagement of the engaging head portions 6 were measured through Embodiments 1 through 9. The results are shown in Table 1 together with a Comparative Example 1 where the two fastening members 1 were used.

TABLE 1

| Com. Ex. & Ex. (Combination of Test Materials) | Percentage of Engagement | Number of Tested Sets | Insertion Force (Rate) | Releasing Force (Rate) | Insertion Force/ Releasing Force |
|---|---|---|---|---|---|
| Com. Ex. 1 (A-A) | 100% | 30 | 450 (100%) | 171 (100%) | 0.38 |
| Example 1 (A-B) | 75% | 5 | 241 (54%) | 157 (92%) | 0.65 |
| Example 2 (A-C) | 50% | 5 | 220 (49%) | 145 (85%) | 0.66 |
| Example 3 (A-D) | 50% | 5 | 127 (28%) | 140 (82%) | 1.10 |
| Example 4 (B-B) | 56% | 5 | 101 (22%) | 152 (89%) | 1.50 |
| Example 5 (B-C) | 38% | 5 | 98 (22%) | 130 (76%) | 1.33 |
| Example 6 (B-D) | 38% | 5 | 63 (14%) | 128 (75%) | 2.03 |
| Example 7 (C-C) | 25% | 5 | 130 (29%) | 129 (75%) | 0.99 |
| Example 8 (C-D) | 25% | 5 | 62 (14%) | 120 (70%) | 1.94 |
| Example 9 (D-D) | 25% | 5 | 44 (10%) | 120 (70%) | 2.73 |

Incidentally, in Table 1, test material A is the fastening member 1 as shown in FIG. 1(*a*); test material B is the fastening member 1A as shown in FIG. 1(*b*); test material C is the fastening member 1B as shown in FIG. 1(*c*); and test material D is the fastening member 1C as shown in FIG. 1(*d*).

The insertion force and the releasing force are shown by unit of Newton, and their ratios are in relation to the insertion force and the releasing force of Comparative Example 1.

As explained above, according to the embodiments of the present invention, as apparent from Table 1, without reducing the releasing force to a great extent, the insertion force can be greatly reduced.

Therefore, it is possible to provide a fastening device F suitable for repeating use.

By changing the provision rate of the projections 7, the insertion force and the releasing force can be easily changed.

Further, by changing a quality of a material of the fastening members 1 and 1A to 1C, combinations of the insertion force and the releasing force can be increased.

Also, since portions where the projections 7 are provided in the base 2 do not have holes different from the portions where the engaging projections 4 are provided, when the fastening members 1A to 1C are bonded by, for example, a two-face adhesive tape, bonding areas are increased in the fastening members 1A to 1C when compared with the fastening member 1, to thereby improve a bonding strength.

Figure 5:
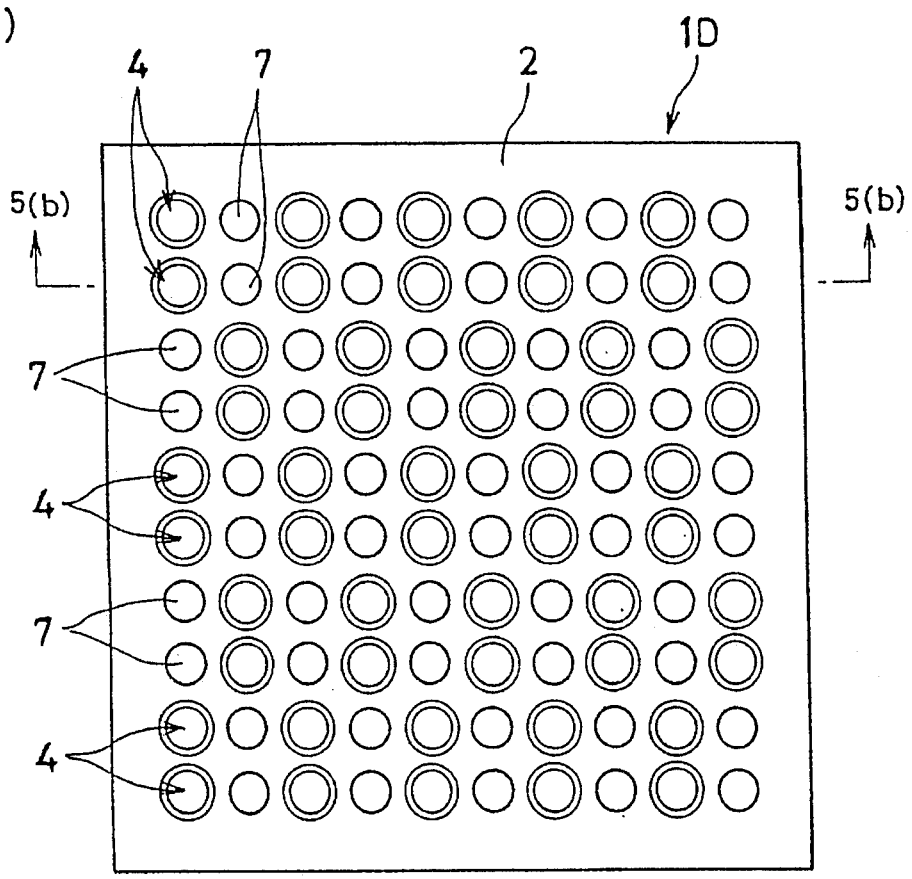
FIG. 5(*a*) is an explanatory plan view of another fastening member to be used in the fastening device.
Figure 5:
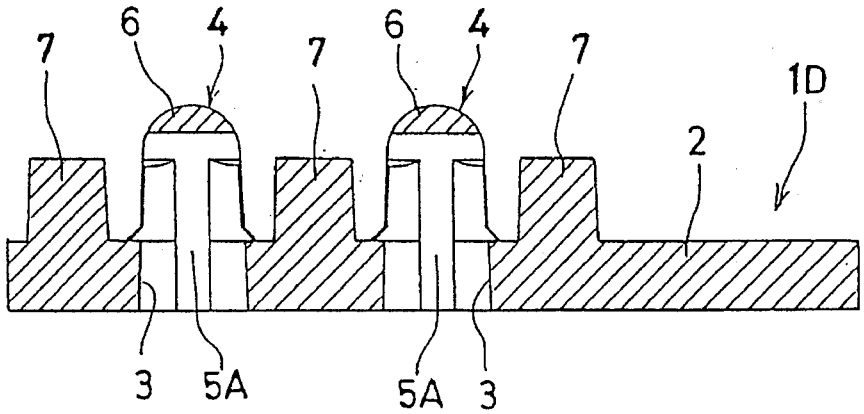
Figure 6:
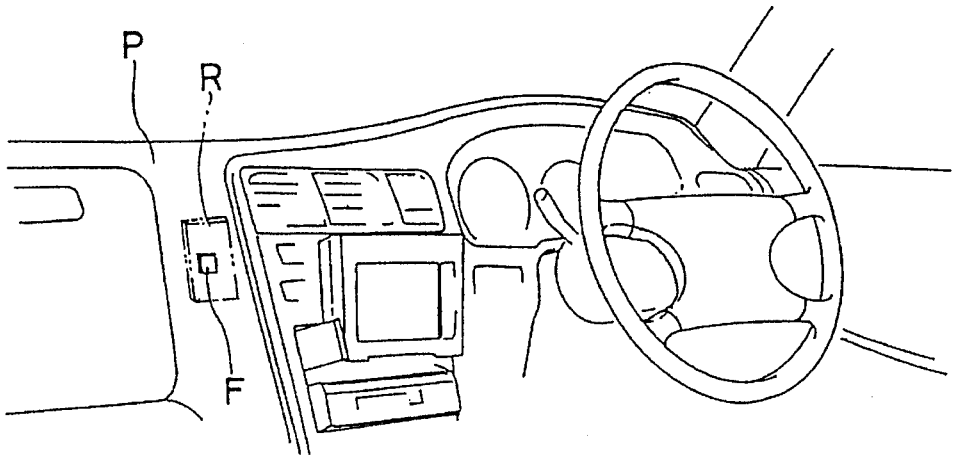
FIGS. 6(*a*) and 6(*i b*) are explanatory views for showing an example of use of the fastening device.
Figure 6:
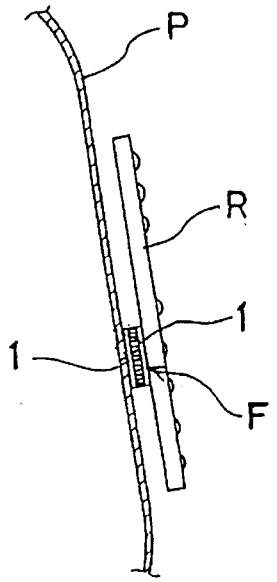
Figure 7:
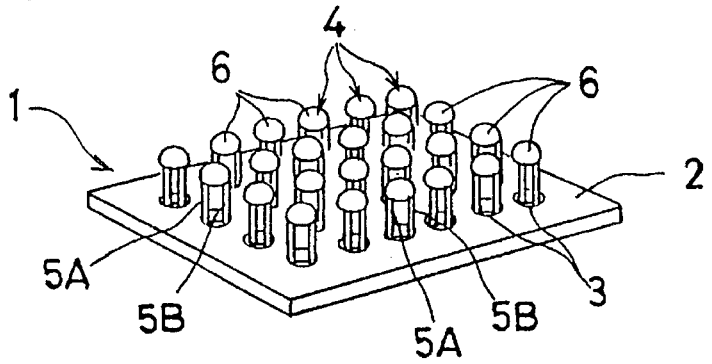
FIG. 7 is a perspective view for showing an example of the fastening member for constituting a conventional fastening device.
Figure 8:
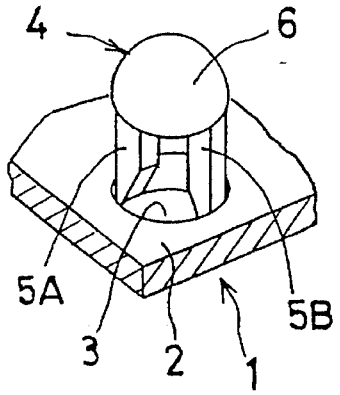
FIG. 8(*a*) is an enlarged perspective view of an engaging projection of a conventional fastening device.
Figure 8B:
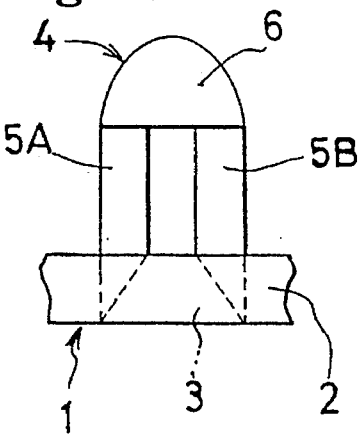
Figure 8:
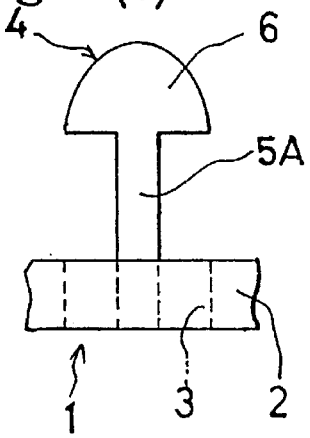

FIGS. 5(*a*) and 5(*b*) are an explanatory plan view and a partially enlarged sectional view, respectively, of a different fastening member to be used for the fastening device. The same portions of this embodiment as those in FIGS. 1–4 and FIGS. 6–12 are denoted by the same symbols, and explanations thereof are omitted.

Incidentally, FIG. 5(*b*) is a partially enlarged sectional view taken along line 5(*b*)—5(*b*) in FIG. 5(*a*).

A fastening member 1D shown in FIG. 5(*a*) is provided with the two engaging projections 4 and the two projections 7 alternately from the top in the odd-numbered vertical rows from the left, and provided with the two projections 7 and the two engaging projections 4 alternately from the top in the even-numbered vertical rows from the left, so that the engaging projections 4 and the projections 7 are provided at a rate of 50%.

When the fastening member 1D shown in FIGS. 5(*a*) and 5(*b*) is combined with a fastening member 1, 1A, 1B, 1C or 1D, the same results as described above can be obtained.

Figure 9:
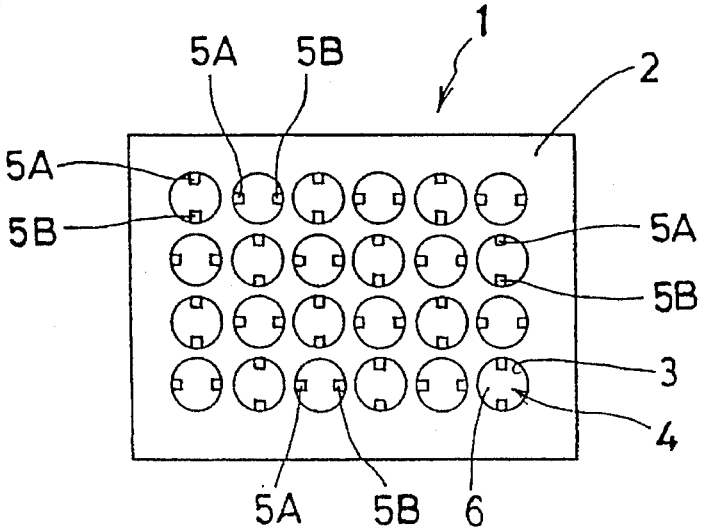
FIG. 9 is a bottom view of a base for showing a positional relationship of legs of the conventional fastening device.
Figure 13A:
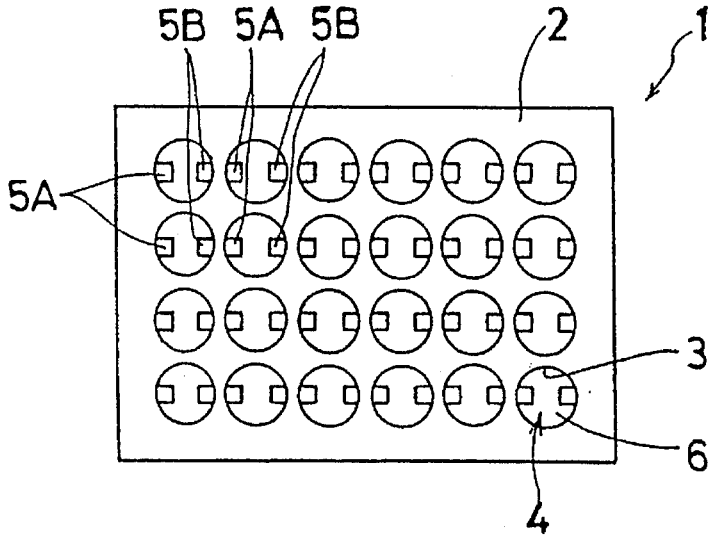
FIGS. 13(*a*), 13(*b*) and 13(*c*) are bottom views of bases for showing positional relationships of the legs.
Figure 13B:
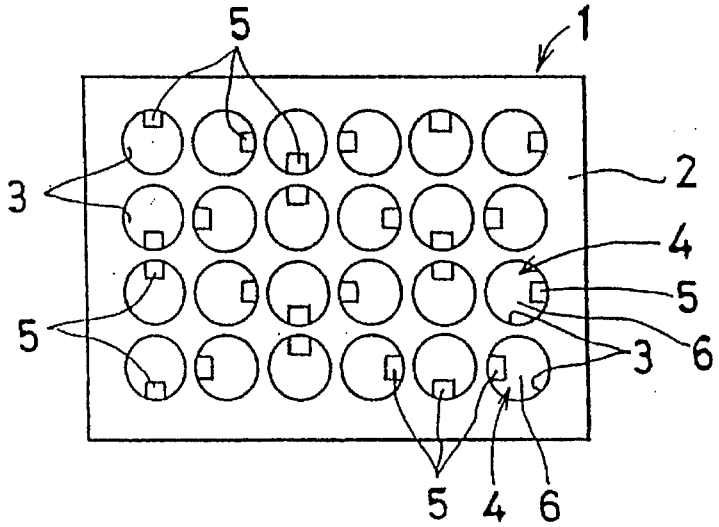
Figure 13C:
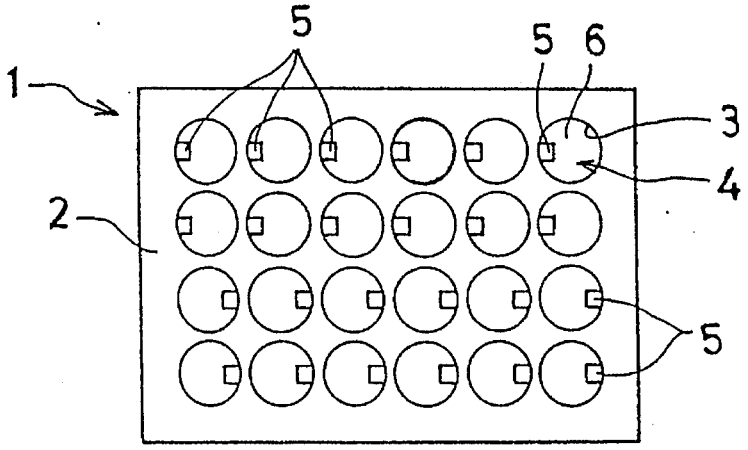

Incidentally, in the above embodiments, the two legs 5A, 5B of each engaging projection 4 are arranged as shown in FIG. 9, but it is needless to say that the two legs may be disposed as shown in FIG. 13(*a*), or one leg 5 as shown in FIGS. 13(*b*) and 13(*c*) may be employed.

Also, although the projection 7 has a frustum shape in the drawings, the projections may, of course, have a hemispherical shape.

As described hereinabove, according to the present invention, the engaging projections in at least one of the fastening members are replaced at a predetermined rate by the non-engaging projections or projections for urging the engaging head portions of the other fastening member to engage the engaging head portions, so that without reducing the releasing force to a great extent, the insertion force can be greatly decreased.

Therefore, the present invention can provide a fastening device suitable for repeating use.

By changing a rate of the projections of the fastening member, it is possible to easily change the insertion force and the releasing force.

Further, by changing a quality of a material of the fastening members, combination of the insertion force and the releasing force can be increased.

Also, since the portions of the base where the projections are provided need not have holes different from the portions of the base where the engaging projections are provided, when the fastening member provided with the projections is fixed by, for example, a two-face adhesive tape, an adhering area of the fastening member provided with the projections is increased when compared with the fastening member without the projections to thereby improve an adhering strength.

While the invention has been explained with reference to the specific embodiments of the invention, the explanation is illustrative, and the invention is limited only by the appended claims.

What is claimed is:

1. A fastening device comprising, two fastening members, each having a flat base portion and a plurality of engaging projections fixed on the base portion, said engaging projections extending from one side of the base portion and being arranged laterally and vertically, each engaging projection having at least one leg fixed to the base portion at one side and an engaging head portion fixed to the other side of the leg, said engaging head portion having a lateral size greater than that of the leg, and non-engaging projections integrally formed on at least one of the fastening members, each non-engaging projection having a height less than the engaging projection so that in case the two fastening members are engaged, when one engaging projection projecting toward one non-engaging projection is pushed laterally by another engaging projection situated adjacent to said one non-engaging projection, an engaging head portion of said one engaging projection is pushed toward said one non-engaging projection and then is returned to an original portion by said one non-engaging projection to thereby engage engaging head portions of said one and another engaging projections.

2. A fastening device according to claim 1, wherein the height of the non-engaging projection is substantially equal to a height of the leg of the engaging projection.

3. A fastening device according to claim 2, wherein said non-engaging projection has a frustum shape.

4. A fastening device according to claim 3 wherein a distance between an outer surface of the non-engaging projection and an outer surface of the leg of the engaging projection situated adjacent to each other is substantially same as an outer diameter of the engaging head portion.

5. A fastening device according to claim 1, wherein said non-engaging projections and the engaging projections are arranged in rows, said non-engaging projections being provided at crossing portions of even-numbered lateral rows from a top and even-numbered vertical rows from a left to provide 75% of the engaging projections and 25% of the non-engaging projections 7.

6. A fastening device according to claim 1, wherein said non-engaging projections and the engaging projections are arranged in rows, said engaging projections and said non-engaging projections being arranged alternately in vertical and lateral rows to provide the engaging projections and the non-engaging projections at 50%, respectively.

7. A fastening device according to claim 1, wherein said non-engaging projections and the engaging projections are arranged in rows, said engaging projections being provided at portions of odd-numbered vertical rows from a left and the non-engaging projections being provided at portions of even-numbered vertical rows from the left to provide the engaging projections and the non-engaging projections at 50%, respectively.

8. A fastening device according to claim 1, wherein said non-engaging projections and the engaging projections are arranged in rows, two engaging projections and two non-engaging projections being arranged alternately from a top in odd-numbered vertical rows from a left, and two non-engaging projections and two engaging projections being arranged alternately from the top in even-numbered vertical rows from the left to provide the engaging projections and the non-engaging projections at a rate of 50%, respectively.

* * * * *